US010514194B2

(12) United States Patent
Avhale et al.

(10) Patent No.: US 10,514,194 B2
(45) Date of Patent: Dec. 24, 2019

(54) MULTI-EVAPORATOR APPLIANCE HAVING A MULTI-DIRECTIONAL VALVE FOR DELIVERING REFRIGERANT TO THE EVAPORATORS

(71) Applicant: WHIRLPOOL CORPORATION, Benton Harbor, MI (US)

(72) Inventors: Amit A. Avhale, St. Joseph, MI (US); Rishikesh Vinayak Kulkarni, St. Joseph, MI (US); E. Calvin Pickles, St. Joseph, MI (US); Yan Zhang, St. Joseph, MI (US); Vijaykumar Sathyamurthi, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 147 days.

(21) Appl. No.: 15/611,294

(22) Filed: Jun. 1, 2017

(65) Prior Publication Data

US 2018/0347885 A1 Dec. 6, 2018

(51) Int. Cl.

| | |
|---|---|
| ***F25D 11/02*** | (2006.01) |
| ***F25B 5/02*** | (2006.01) |
| ***F25B 5/04*** | (2006.01) |
| ***F25B 41/04*** | (2006.01) |
| ***F25B 49/02*** | (2006.01) |

(Continued)

(52) U.S. Cl.

CPC ..... *F25D 11/022* (2013.01); *F25B 5/02* (2013.01); *F25B 5/04* (2013.01); *F25B 41/04* (2013.01); *F25B 49/02* (2013.01); *F25D 17/065* (2013.01); *F25D 29/00* (2013.01); *F25B 2341/0661* (2013.01)

(58) Field of Classification Search

CPC .... F25D 11/002; F25D 11/02; F25D 2400/34; F25B 2400/0409; F25B 2313/02321; F25B 2600/2511; F25B 2600/2503; F25B 2600/2515; F25B 2600/2523; F25B 39/028

See application file for complete search history.

(56) References Cited

U.S. PATENT DOCUMENTS

| | | | |
|---|---|---|---|
| 2,515,825 | A | 7/1950 | Grant |
| 2,873,041 | A | 2/1959 | Allen |

(Continued)

FOREIGN PATENT DOCUMENTS

| | | | |
|---|---|---|---|
| CN | 101967746 | A | 2/2011 |
| CN | 105177914 | A | 12/2015 |

(Continued)

*Primary Examiner* — Cassey D Bauer
(74) *Attorney, Agent, or Firm* — Price Heneveld LLP

(57) ABSTRACT

A refrigerating appliance includes a refrigerant line having a compressor and a condenser. A thermal exchange media is delivered from the condenser and through the refrigerant line to at least a freezer evaporator of a plurality of evaporators, wherein the thermal exchange media leaving the freezer evaporator defines spent media that is returned to the compressor. A multi-directional outlet valve selectively delivers the thermal exchange media to the freezer evaporator, wherein the multi-directional outlet valve also selectively delivers the thermal exchange media to at least one secondary evaporator of the plurality of evaporators to define a partially-spent media that is delivered to the freezer evaporator.

10 Claims, 7 Drawing Sheets

(51) Int. Cl.
*F25D 17/06* (2006.01)
*F25D 29/00* (2006.01)

(56) References Cited

U.S. PATENT DOCUMENTS 2,934,023 A 4/1960 Lamkin et al.
3,196,553 A 7/1965 Deaton et al.
3,218,730 A 11/1965 Menk et al.
3,342,961 A 9/1967 Deaton et al.
3,653,807 A 4/1972 Platt
3,805,404 A 4/1974 Gould
3,953,146 A 4/1976 Sowards
3,999,304 A 12/1976 Doty
4,134,518 A 1/1979 Menchen
4,137,647 A 2/1979 Clark, Jr.
4,260,876 A 4/1981 Hochheiser
4,261,179 A 4/1981 Dageford
4,860,921 A 8/1989 Gidseg
4,870,735 A 10/1989 Jahr, Jr. et al.
5,285,664 A 2/1994 Chang et al.
5,600,966 A 2/1997 Valence et al.
5,628,122 A 5/1997 Spinardi
5,666,817 A 9/1997 Schulak et al.
5,720,536 A 2/1998 Jenkins et al.
5,927,095 A 7/1999 Lee
5,946,934 A 9/1999 Kim et al.
5,979,174 A 11/1999 Kim et al.
6,041,606 A 3/2000 Kim
6,073,458 A 6/2000 Kim
6,401,482 B1 6/2002 Lee et al.
6,598,410 B2 7/2003 Temmyo et al.
6,793,010 B1 9/2004 Manole
6,957,501 B2 10/2005 Park et al.
6,973,799 B2 12/2005 Kuehl et al.
6,983,615 B2 1/2006 Winders et al.
7,008,032 B2 3/2006 Chekal et al.
7,055,262 B2 6/2006 Goldberg et al.
7,093,453 B2 8/2006 Asan et al.
7,117,612 B2 10/2006 Slutsky et al.
7,127,904 B2 10/2006 Schmid
7,143,605 B2 12/2006 Rohrer et al.
7,162,812 B2 1/2007 Cimetta et al.
7,181,921 B2 2/2007 Nuiding
7,207,181 B2 4/2007 Murray et al.
7,254,960 B2 8/2007 Schmid et al.
7,504,784 B2 3/2009 Asada et al.
7,610,773 B2 11/2009 Rafalovich et al.
7,624,514 B2 12/2009 Konabe et al.
7,665,225 B2 2/2010 Goldberg et al.
7,707,860 B2 5/2010 Hong et al.
7,775,065 B2 8/2010 Ouseph et al.
7,866,057 B2 1/2011 Grunert et al.
7,895,771 B2 3/2011 Prajescu et al.
7,934,695 B2 5/2011 Sim et al.
7,980,093 B2 7/2011 Kuehl et al.
8,024,948 B2 9/2011 Kitamura et al.
8,056,254 B2 11/2011 Loffler et al.
8,074,469 B2 12/2011 Hamel et al.
8,079,157 B2 12/2011 Balerdi Azpilicueta et al.
8,099,975 B2 1/2012 Rafalovich et al.
8,104,191 B2 1/2012 Ricklefs et al.
8,166,669 B2 5/2012 Park et al.
8,182,612 B2 5/2012 Grunert
8,240,064 B2 8/2012 Steffens
8,245,347 B2 8/2012 Goldberg et al.
8,266,813 B2 9/2012 Grunert et al.
8,266,824 B2 9/2012 Steiner
8,276,293 B2 10/2012 Ricklefs et al.
8,377,224 B2 2/2013 Grunert
8,382,887 B1 2/2013 Alsaffar
8,434,317 B2 5/2013 Besore
8,438,750 B2 5/2013 Dittmer et al.
8,484,862 B2 7/2013 Nawrot et al.
8,572,862 B2 11/2013 TeGrotenhuis
8,601,830 B2 12/2013 Lee et al.
8,615,895 B2 12/2013 Shin et al.
8,656,604 B2 2/2014 Ediger et al.
8,667,705 B2 3/2014 Shin et al.
8,695,230 B2 4/2014 Noh et al.
8,770,682 B2 7/2014 Lee et al.
8,789,287 B2 7/2014 Kim et al.
8,789,290 B2 7/2014 Grunert
8,857,071 B2 10/2014 Lee et al.
8,910,394 B2 12/2014 Steffens
8,915,104 B2 12/2014 Beihoff et al.
8,984,767 B2 3/2015 Grunert et al.
9,010,145 B2 4/2015 Lim et al.
9,022,228 B2 5/2015 Grunert
9,027,256 B2 5/2015 Kim et al.
9,027,371 B2 5/2015 Beihoff et al.
9,052,142 B2 6/2015 Kim et al.
9,062,410 B2 6/2015 Ahn et al.
9,085,843 B2 7/2015 Doh et al.
9,103,569 B2 8/2015 Cur et al.
9,134,067 B2 9/2015 Ahn et al.
9,140,472 B2 9/2015 Shin et al.
9,140,481 B2 9/2015 Cur et al.
9,212,450 B2 12/2015 Grunert et al.
9,249,538 B2 2/2016 Bison et al.
9,299,332 B2 3/2016 Je
9,303,882 B2 4/2016 Hancock
9,328,448 B2 5/2016 Doh et al.
9,328,449 B2 5/2016 Doh et al.
9,334,601 B2 5/2016 Doh et al.
9,335,095 B2 5/2016 Bison et al.
9,356,542 B2 5/2016 Ragogna et al.
9,359,714 B2 6/2016 Contarini et al.
9,372,031 B2 6/2016 Contarini et al.
9,435,069 B2 9/2016 Contarini et al.
9,487,910 B2 11/2016 Huang et al.
9,506,689 B2 11/2016 Carbajal et al.
9,534,329 B2 1/2017 Contarini et al.
9,534,340 B2 1/2017 Cavarretta et al.
9,605,375 B2 3/2017 Frank et al.
9,644,306 B2 5/2017 Doh et al.
9,663,894 B2 5/2017 Kim et al.
2004/0139757 A1 7/2004 Kuehl et al.
2005/0217139 A1 10/2005 Hong
2005/0229614 A1 10/2005 Ansted
2006/0070385 A1 4/2006 Narayanamurthy et al.
2006/0144076 A1 7/2006 Daddis, Jr. et al.
2006/0196217 A1 9/2006 Duarte et al.
2007/0033962 A1 2/2007 Kang et al.
2008/0141699 A1 6/2008 Rafalovich et al.
2008/0196266 A1 8/2008 Jung et al.
2008/0307823 A1 12/2008 Lee et al.
2009/0071032 A1 3/2009 Kreutzfeldt et al.
2009/0158767 A1 6/2009 McMillin
2009/0158768 A1 6/2009 Rafalovich et al.
2009/0165491 A1 7/2009 Rafalovich et al.
2009/0260371 A1 10/2009 Kuehl et al.
2009/0266089 A1 10/2009 Haussmann
2010/0011608 A1 1/2010 Grunert et al.
2010/0101606 A1 4/2010 Grunert
2010/0107703 A1 5/2010 Hisano et al.
2010/0146809 A1 6/2010 Grunert et al.
2010/0154240 A1 6/2010 Grunert
2010/0212368 A1 8/2010 Kim et al.
2010/0230081 A1 9/2010 Becnel et al.
2010/0258275 A1 10/2010 Koenig et al.
2010/0288471 A1 11/2010 Summerer
2011/0011119 A1 1/2011 Kuehl et al.
2011/0030238 A1 2/2011 Nawrot et al.
2011/0036556 A1 2/2011 Bison et al.
2011/0072849 A1 3/2011 Kuehl et al.
2011/0209484 A1 9/2011 Krausch et al.
2011/0209860 A1 9/2011 Koenig et al.
2011/0277334 A1 11/2011 Lee et al.
2011/0280736 A1 11/2011 Lee et al.
2012/0017456 A1 1/2012 Grunert
2012/0266627 A1 10/2012 Lee
2012/0272689 A1 11/2012 Eiger et al.
2013/0008049 A1 1/2013 Patil
2013/0104946 A1 5/2013 Grunert et al.

(56) References Cited

U.S. PATENT DOCUMENTS

| | | | |
|---|---|---|---|
| 2013/0111941 | A1 | 5/2013 | Yu et al. |
| 2013/0212894 | A1 | 8/2013 | Kim et al. |
| 2013/0255094 | A1 | 10/2013 | Bommels et al. |
| 2013/0263630 | A1 | 10/2013 | Doh et al. |
| 2013/0276327 | A1 | 10/2013 | Doh et al. |
| 2013/0318813 | A1 | 12/2013 | Hong et al. |
| 2013/0340797 | A1 | 12/2013 | Bommels et al. |
| 2014/0020260 | A1 | 1/2014 | Carow et al. |
| 2014/0026433 | A1 | 1/2014 | Bison et al. |
| 2014/0075682 | A1 | 3/2014 | Filippetti et al. |
| 2014/0109428 | A1 | 4/2014 | Kim et al. |
| 2014/0190032 | A1 | 7/2014 | Lee et al. |
| 2014/0216706 | A1 | 8/2014 | Melton et al. |
| 2014/0245758 | A1* | 9/2014 | Gu ..... F25D 29/00 62/56 |
| 2014/0260356 | A1 | 9/2014 | Wu |
| 2014/0290091 | A1 | 10/2014 | Bison et al. |
| 2014/0366397 | A1 | 12/2014 | Wakizaka et al. |
| 2015/0015133 | A1 | 1/2015 | Carbajal et al. |
| 2015/0033806 | A1 | 2/2015 | Cerrato et al. |
| 2015/0114600 | A1 | 4/2015 | Chen et al. |
| 2015/0285551 | A1 | 10/2015 | Aiken et al. |
| 2015/0308034 | A1 | 10/2015 | Cavarretta et al. |
| 2015/0322618 | A1 | 11/2015 | Bisaro et al. |
| 2016/0010271 | A1 | 1/2016 | Shin et al. |
| 2016/0040350 | A1 | 2/2016 | Xu et al. |
| 2016/0083894 | A1 | 3/2016 | Bison et al. |
| 2016/0083896 | A1 | 3/2016 | Ryoo et al. |
| 2016/0115636 | A1 | 4/2016 | Kim et al. |
| 2016/0115639 | A1 | 4/2016 | Kim et al. |
| 2016/0138208 | A1 | 5/2016 | Bison et al. |
| 2016/0138209 | A1 | 5/2016 | Kitayama et al. |
| 2016/0145793 | A1 | 5/2016 | Ryoo et al. |
| 2016/0169540 | A1 | 6/2016 | Hancock |
| 2016/0178267 | A1 | 6/2016 | Hao et al. |
| 2016/0186374 | A1 | 6/2016 | Ryoo et al. |
| 2016/0258671 | A1 | 9/2016 | Allard et al. |
| 2016/0265833 | A1 | 9/2016 | Yoon et al. |
| 2016/0282032 | A1 | 9/2016 | Gomes et al. |
| 2016/0290702 | A1 | 10/2016 | Sexton et al. |
| 2016/0305696 | A1 | 10/2016 | Kobayashi et al. |
| 2016/0348957 | A1 | 12/2016 | Hitzelberger et al. |

FOREIGN PATENT DOCUMENTS

| | | | |
|---|---|---|---|
| CN | 105696291 | A | 6/2016 |
| DE | 3147796 | | 3/1983 |
| DE | 3738031 | A1 | 5/1989 |
| DE | 4304372 | A1 | 8/1994 |
| DE | 4409607 | A1 | 10/1994 |
| DE | 10002742 | C1 | 6/2001 |
| DE | 10116238 | B4 | 3/2005 |
| DE | 10002743 | B4 | 1/2006 |
| DE | 102005041145 | A1 | 3/2007 |
| DE | 102006018469 | A1 | 10/2007 |
| DE | 102007052835 | A1 | 5/2009 |
| DE | 102008033388 | A1 | 1/2010 |
| DE | 102008054832 | A1 | 7/2010 |
| DE | 102009046921 | | 5/2011 |
| DE | 102012223777 | A1 | 6/2014 |
| DE | 112012006737 | T5 | 4/2015 |
| EP | 468573 | A1 | 1/1992 |
| EP | 0816549 | A2 | 1/1998 |
| EP | 999302 | A1 | 5/2000 |
| EP | 1055767 | A1 | 11/2000 |
| EP | 1987190 | A1 | 11/2008 |
| EP | 2134896 | B1 | 12/2009 |
| EP | 2189568 | A1 | 5/2010 |
| EP | 2202349 | | 6/2010 |
| EP | 2284310 | A1 | 2/2011 |
| EP | 2324152 | B1 | 5/2011 |
| EP | 2341178 | A1 | 7/2011 |
| EP | 2386679 | | 11/2011 |
| EP | 2455526 | A1 | 5/2012 |
| EP | 2466001 | A1 | 6/2012 |
| EP | 2497856 | A1 | 9/2012 |
| EP | 2559805 | A1 | 2/2013 |
| EP | 2581489 | A1 | 4/2013 |
| EP | 2612964 | A1 | 7/2013 |
| EP | 2612965 | A1 | 7/2013 |
| EP | 2612966 | A1 | 7/2013 |
| EP | 2631578 | | 8/2013 |
| EP | 2634301 | A1 | 9/2013 |
| EP | 2708636 | A1 | 3/2014 |
| EP | 2708639 | A1 | 3/2014 |
| EP | 2733257 | A1 | 5/2014 |
| EP | 2746455 | A1 | 6/2014 |
| EP | 2594687 | B1 | 9/2014 |
| EP | 2966215 | | 1/2016 |
| EP | 2993427 | A1 | 3/2016 |
| EP | 3015594 | A1 | 5/2016 |
| EP | 2468949 | B1 | 6/2016 |
| EP | 3034675 | A1 | 6/2016 |
| EP | 3241944 | | 11/2017 |
| GB | 2087029 | A | 5/1982 |
| JP | 2000018796 | | 1/2000 |
| JP | 2004053055 | | 2/2004 |
| JP | 2005027768 | | 2/2005 |
| JP | 2006017338 | | 1/2006 |
| JP | 2006187449 | | 7/2006 |
| JP | 2013019623 | A | 1/2013 |
| JP | 2013085687 | | 5/2013 |
| KR | 20100031929 | A | 3/2010 |
| NL | 7801958 | A | 8/1979 |
| WO | 8602149 | | 4/1986 |
| WO | 03016793 | | 2/2003 |
| WO | 2004106737 | A1 | 12/2004 |
| WO | 2005001357 | A1 | 1/2005 |
| WO | 2005032322 | A2 | 4/2005 |
| WO | 2007013327 | A1 | 2/2007 |
| WO | 2007093461 | A1 | 8/2007 |
| WO | 2008077708 | A1 | 7/2008 |
| WO | 2008110451 | A1 | 9/2008 |
| WO | 2008151938 | A1 | 12/2008 |
| WO | 2009031812 | A2 | 3/2009 |
| WO | 2009059874 | A1 | 5/2009 |
| WO | 2009077226 | A1 | 6/2009 |
| WO | 2009077227 | A1 | 6/2009 |
| WO | 2009077291 | A1 | 6/2009 |
| WO | 2009089460 | A2 | 7/2009 |
| WO | 2010028992 | A1 | 3/2010 |
| WO | 2010040635 | A1 | 4/2010 |
| WO | 2010071355 | A2 | 6/2010 |
| WO | 2010102892 | A1 | 9/2010 |
| WO | 2010112321 | A1 | 10/2010 |
| WO | 2010118939 | A1 | 10/2010 |
| WO | 2011057954 | A2 | 5/2011 |
| WO | 2011061068 | A1 | 5/2011 |
| WO | 2012022803 | A1 | 2/2012 |
| WO | 2012065916 | A1 | 5/2012 |
| WO | 2012093059 | A1 | 7/2012 |
| WO | 2012101028 | A1 | 8/2012 |
| WO | 2012134149 | A2 | 10/2012 |
| WO | 2012138136 | A2 | 10/2012 |
| WO | 2013129779 | A1 | 9/2013 |
| WO | 2013144763 | A2 | 10/2013 |
| WO | 2013144764 | A1 | 10/2013 |
| WO | 2014001950 | A1 | 1/2014 |
| WO | 2014040923 | A1 | 3/2014 |
| WO | 2014041097 | A1 | 3/2014 |
| WO | 2014076149 | A1 | 5/2014 |
| WO | 2014095790 | A1 | 6/2014 |
| WO | 2014102073 | A1 | 7/2014 |
| WO | 2014102144 | A1 | 7/2014 |
| WO | 2014102317 | A2 | 7/2014 |
| WO | 2014102322 | A1 | 7/2014 |
| WO | 2014154278 | A1 | 10/2014 |
| WO | 2015003742 | A1 | 1/2015 |
| WO | 2015028270 | A1 | 3/2015 |
| WO | 2015074837 | A1 | 5/2015 |
| WO | 2015082011 | A1 | 6/2015 |
| WO | 2015101386 | A1 | 7/2015 |
| WO | 2015101387 | A1 | 7/2015 |

(56) References Cited

FOREIGN PATENT DOCUMENTS

| | | | |
|---|---|---|---|
| WO | 2015101388 | A1 | 7/2015 |
| WO | 2015101892 | A1 | 7/2015 |
| WO | 2015160172 | A1 | 10/2015 |
| WO | 2016006900 | A1 | 1/2016 |
| WO | 2016020852 | A1 | 2/2016 |
| WO | 2016063179 | | 4/2016 |
| WO | 2016085432 | | 6/2016 |
| WO | 2016095970 | | 6/2016 |
| WO | 2016150660 | A1 | 9/2016 |

* cited by examiner

MULTI-EVAPORATOR APPLIANCE HAVING A MULTI-DIRECTIONAL VALVE FOR DELIVERING REFRIGERANT TO THE EVAPORATORS

FIELD OF THE DEVICE

The device is in the field of refrigerating appliances, and more specifically, a refrigerating appliance having a multi-directional outlet for delivering refrigerant to multiple evaporators for performing a plurality of refrigerating functions.

SUMMARY

In at least one aspect, a refrigerating appliance includes a refrigerant line having a compressor and a condenser. A thermal exchange media is delivered from the condenser and through the refrigerant line to at least a freezer evaporator of a plurality of evaporators, wherein the thermal exchange media leaving the freezer evaporator defines spent media that is returned to the compressor. A multi-directional outlet valve selectively delivers the thermal exchange media to the freezer evaporator, wherein the multi-directional outlet valve also selectively delivers the thermal exchange media to at least one secondary evaporator of the plurality of evaporators to define a partially-spent media that is delivered to the freezer evaporator.

In at least another aspect, a refrigerating appliance includes a refrigerant line having a compressor and a thermal exchange media. At least one evaporator of a plurality of evaporators selectively receives the thermal exchange media and includes a freezer evaporator, a pantry evaporator and a refrigerator evaporator. A multi-directional inlet valve receives the thermal exchange media from at least one of the compressor, the pantry evaporator and the refrigerator evaporator, wherein the multi-directional inlet valve delivers the thermal exchange media to the freezer evaporator.

In at least another aspect, a method for operating a refrigerating appliance includes steps of selecting a refrigerating mode of the appliance, delivering a thermal exchange media to a multi-directional outlet valve, operating the multi-directional outlet valve based upon a selected mode of the appliance, delivering the thermal exchange media through a multi-directional inlet valve and, in all operating modes of the appliance, delivering the thermal exchange media through a freezing evaporator and returning the thermal exchange media to a compressor.

These and other features, advantages, and objects of the present device will be further understood and appreciated by those skilled in the art upon studying the following specification, claims, and appended drawings.

DETAILED DESCRIPTION OF EMBODIMENTS

Figure 1:
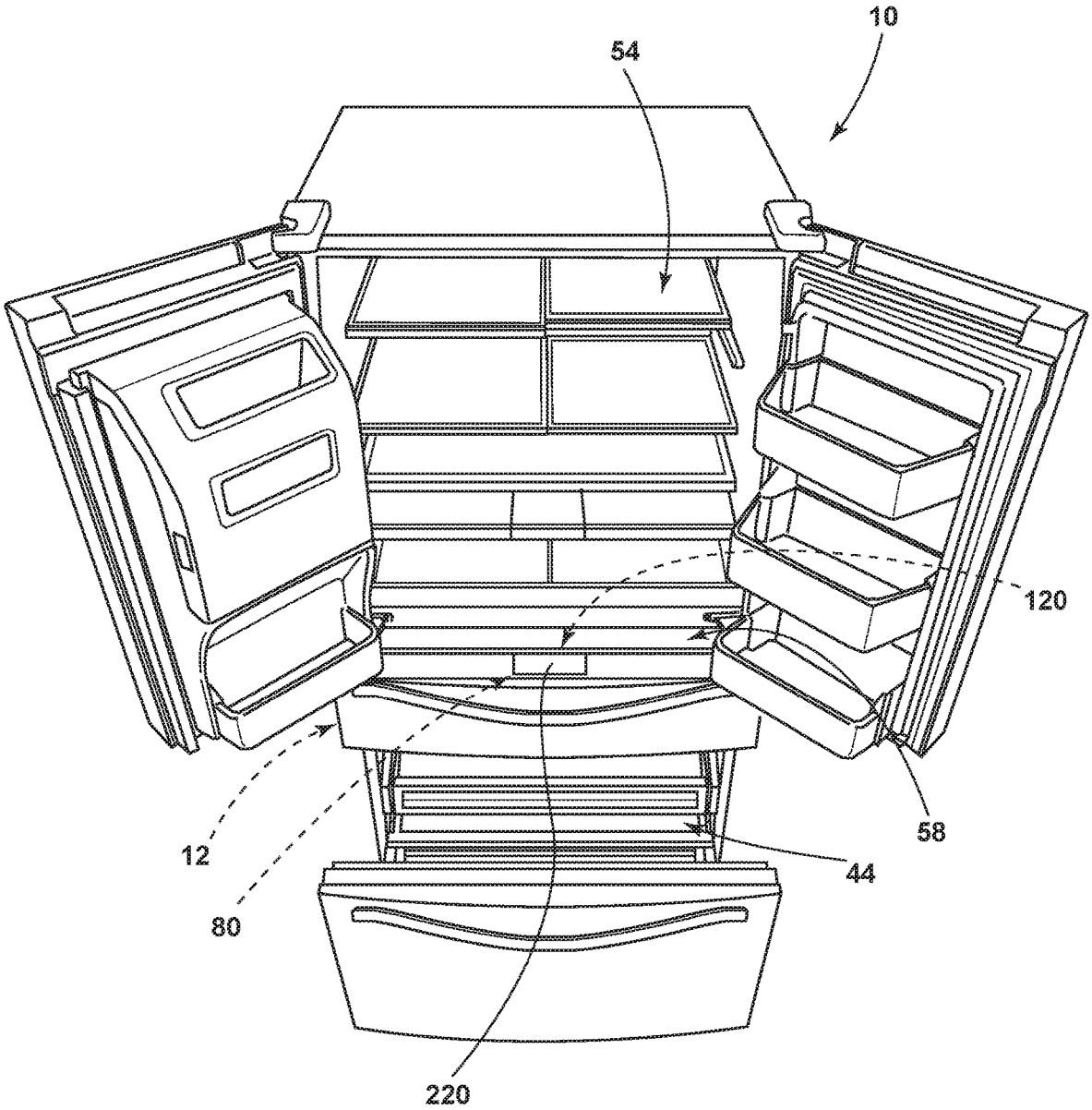
FIG. 1 is a front perspective view of a refrigerating appliance having a plurality of operable panels each shown in the open position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-7, a refrigerating appliance 10 can include a multi-evaporator refrigeration system 12 that can be operated using a single compressor 14 and a single condenser 16 for charging a thermal exchange media 18 that can be delivered to one or more of a plurality of evaporators of the multi-evaporator refrigeration system 12. According to various aspects of the device, the appliance 10 can include a refrigerant line 20 having a compressor 14 and a condenser 16. A thermal exchange media 18 is disposed within the refrigerant line 20 and is delivered from the condenser 16, as a charged media 22, and through the refrigerant line 20 through at least a freezer evaporator 24 of the plurality of evaporators. The thermal exchange media 18 leaving the freezer evaporator 24 defines a spent media 26 that is then returned to the compressor 14. In order to deliver the thermal exchange media 18 to the plurality of evaporators, a multi-directional outlet valve 28 selectively delivers the thermal exchange media 18 to the freezer evaporator 24. The multi-directional outlet valve 28 is also adapted to selectively deliver the thermal exchange media 18, in the form of the charged media 22, to at least one secondary evaporator 30 of the plurality of evaporators. The thermal exchange media 18 leaving the one or more secondary evaporators 30 defines a partially-spent media 32. This partially-spent media 32 is then delivered to the freezer evaporator 24 and ultimately returned back to the compressor 14 to continue operation of the refrigerant cycle. As discussed above, the thermal exchange media 18 leaving the freezer evaporator 24 is typically a spent media 26. According to the various aspects of the device, the thermal exchange media 18, regardless of the cooling mode that is being performed by the multi-evaporator refrigeration system 12, is always directed through the freezer evaporator 24 before returning to the compressor 14.

Referring again to FIGS. 1-7, the refrigerant line 20 can include a multi-directional inlet valve 40 that selectively receives the thermal exchange media 18 for delivery to the freezer evaporator 24. In this manner, the thermal exchange media 18 can be delivered from the multi-directional outlet valve 28 and directly to the multi-directional inlet valve 40 in the form of the charged media 22. This cooling mode defines a freezer-cooling mode 42 where all of the charged media 22 is directed from the multi-directional outlet valve 28, through the multi-directional inlet valve 40 and to the freezer evaporator 24 for cooling a freezer compartment 44 of the appliance 10. The multi-directional inlet valve 40, during a pantry-cooling mode 46, refrigerator-cooling mode 48 or combination refrigerator/pantry-cooling mode 50 is adapted to receive the partially-spent media 32 from at least one of the secondary evaporators 30 for delivery to the freezer evaporator 24 via the multi-directional inlet valve 40. The secondary evaporators 30 can include a refrigerator evaporator 52 that is in communication with a refrigerator compartment 54 of the appliance 10. Another secondary evaporator 30 can include a pantry evaporator 56 that is in communication with a pantry compartment 58 of the appliance 10.

Referring again to FIGS. 2-7, it is contemplated that each of the freezer, refrigerator and pantry evaporators 24, 52, 56 includes a dedicated expansion device 60 that is included within the refrigerant line 20 and positioned downstream of the multi-directional outlet valve 28. Accordingly, as the thermal exchange media 18 leaves the multi-directional outlet valve 28, the thermal exchange media 18 travels through a dedicated expansion device 60 before the thermal exchange media 18 is delivered to a respective evaporator of the freezer, refrigerator and pantry evaporators 24, 52, 56.

During operation of the multi-evaporator refrigeration system 12, the thermal exchange media 18 is typically delivered to the compressor 14 from the freezer evaporator 24. During this compression step, the thermal exchange media 18 leaving the compressor 14 defines a high-pressure high-temperature vapor 70 that is delivered to the condenser 16. As the thermal exchange media 18 that is in the form of the high-pressure high-temperature vapor 70 moves through the condenser 16, heat 100 is rejected from the thermal exchange media 18, and from the condenser 16. The thermal exchange media 18 leaving the condenser 16 is in the form of a high-pressure high-temperature liquid 72 that is moved through the refrigerant line 20. Typically, the thermal exchange media 18 in this state defines the charged media 22. The thermal exchange media 18 in this state of a high-pressure high-temperature liquid 72 is then delivered to the multi-directional outlet valve 28.

Referring again to FIGS. 1-7, the multi-directional outlet valve 28 is typically operated by a processor 80 so that the charged media 22 is delivered to the appropriate evaporator of the plurality of evaporators for performing a particular cooling mode of the appliance 10. After leaving the multi-directional outlet valve 28, the charged media 22 in the form of the high-pressure high-temperature liquid 72 is then moved through a dedicated expansion device 60 disposed within the refrigerant line 20 leading to a respective evaporator of the plurality of evaporators. After leaving the expansion device 60, the thermal exchange media 18 is depressurized to define a low-pressure low-temperature liquid 90. In this cooled liquid state, the thermal exchange media 18 is then passed through one of the freezer, pantry and refrigerator evaporators 24, 56, 52 that corresponds to the dedicated expansion device 60. As the thermal exchange media 18 passes through the freezer, pantry and refrigerator evaporators 24, 56, 52, the thermal exchange media 18 changes phase from a liquid to a gas. During this phase change, heat 100 is absorbed by the thermal exchange media 18 and the air around the corresponding evaporator is cooled.

Figure 2:
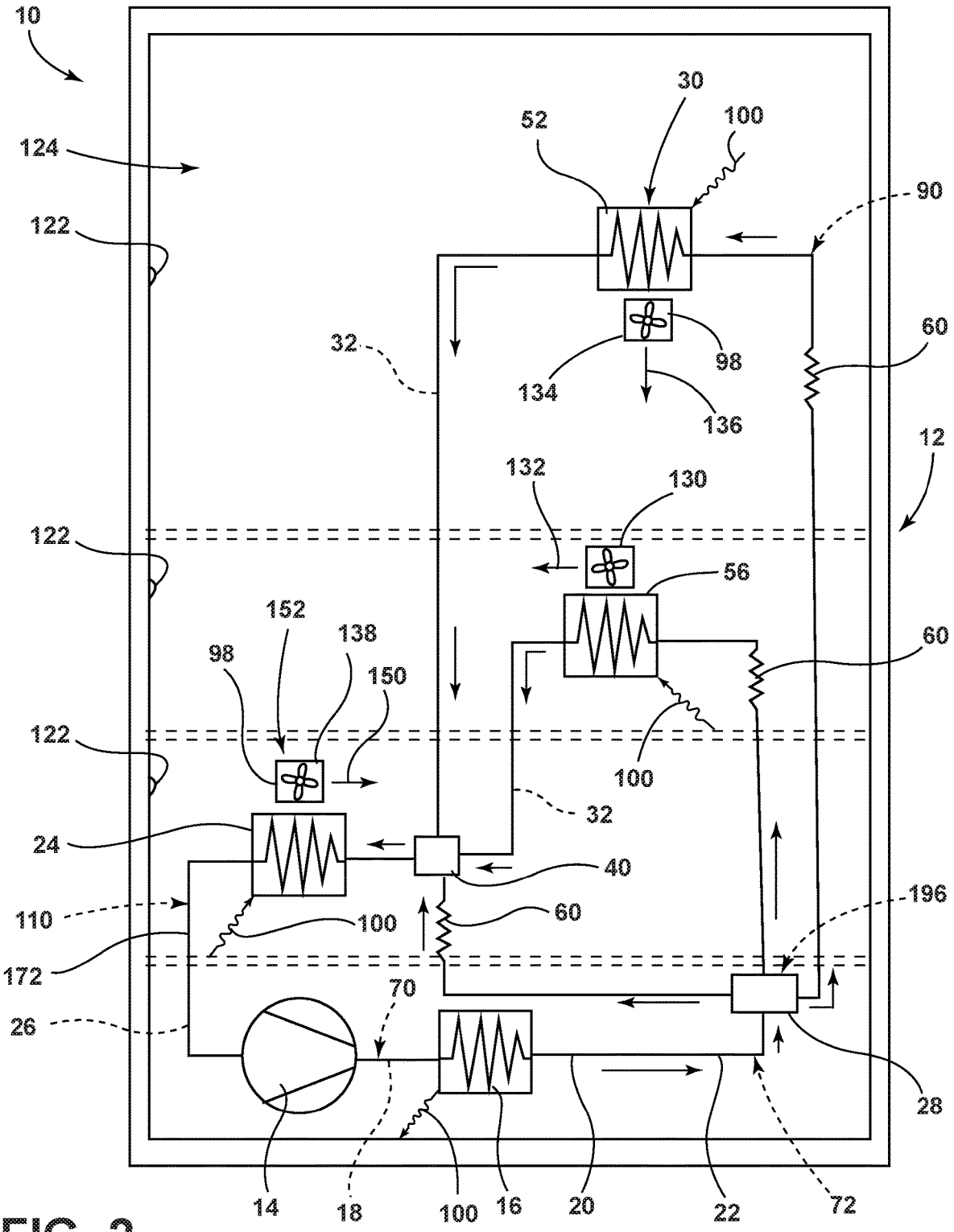
FIG. 2 is a schematic diagram illustrating an appliance having an aspect of the multi-evaporator refrigeration system.
Figure 3:
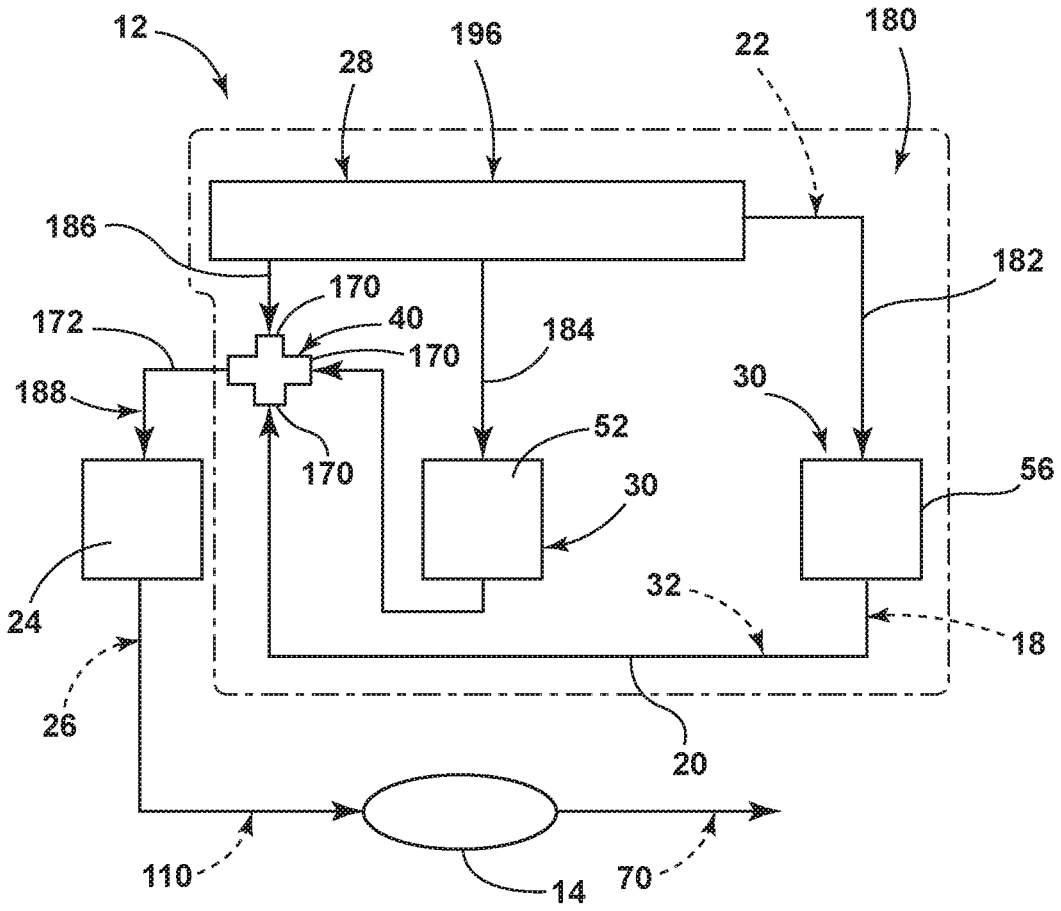
FIG. 3 is a schematic flow diagram illustrating operation of a multi-directional outlet valve used in conjunction with the multi-evaporator refrigeration system.
Figure 4:
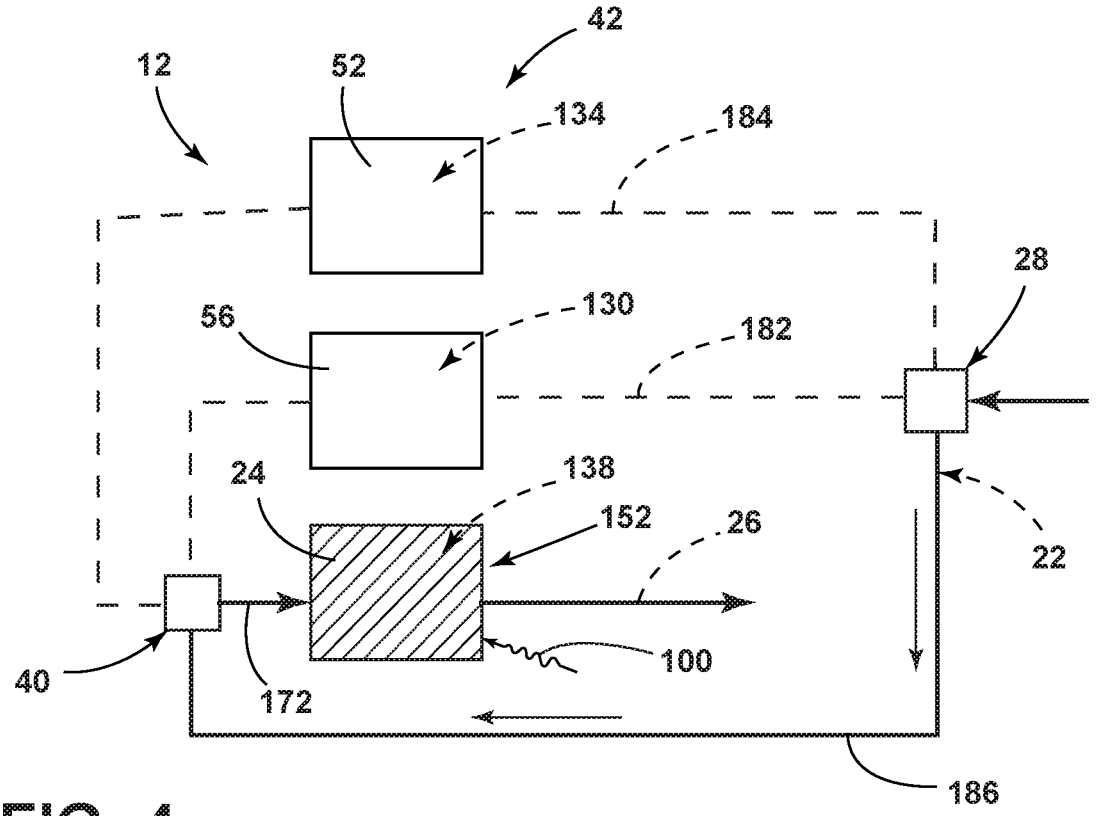
FIG. 4 is a schematic diagram illustrating a freezer-cooling mode of the multi-evaporator refrigeration system.

As exemplified in FIGS. 2 and 3, a fan 98 is disposed proximate each evaporator so that as the heat 100 is absorbed within each of the evaporators and the temperature around the respective evaporator is decreased, the fan 98 can be activated to direct this cooled air around the evaporator into a dedicated compartment in the appliance 10. After leaving the evaporator, the thermal exchange media 18 is then in the form of a low-pressure low-temperature vapor 110 that can be delivered back to the compressor 14 to restart the cycle again.

Typically, the thermal exchange media 18 leaving one or both of the refrigerator evaporators 52 defines a partially-spent media 32. This partially-spent media 32 is then delivered to the freezer evaporator 24 where additional phase change of the partially-spent media 32 may occur. The thermal exchange media 18 leaving the freezer evaporator 24 is in the form of the spent media 26. The term "spent media" is used to further define the delivery of the thermal exchange media 18 from the freezer evaporator 24 and directly to the compressor 14. Accordingly, the spent media 26 does not typically undergo any additional phase change operations within an evaporator or other heat exchanger as it moves to the compressor 14 from the freezer evaporator 24. As such, the spent media 26 may contain part vapor and part liquid forms of the thermal exchange media 18.

Referring again to FIGS. 1-7, the selection of the appropriate cooling mode of the appliance 10 can be determined based upon particular settings of a desired temperature 120 for each compartment that may be selected, as desired, by the user of the appliance 10. Temperature sensors 122 within each of the freezer, pantry and refrigerator compartments 44, 58, 54 are adapted to monitor an actual temperature 124 therein and deliver this data to a processor 80 for the appliance 10. The processor 80 can then compare the actual temperature 124 within the compartment that is measured by the temperature sensor 122 against the desired temperature 120 set by the user. Where the actual temperature 124 is elevated by a predefined amount above the desired temperature 120, the appliance 10 can activate the multi-evaporator refrigeration system 12 and operate the multi-directional outlet valve 28 to deliver the charged media 22 to the appropriate evaporator or evaporators of the freezer, refrigerator and pantry evaporators 24, 52, 56 for performing the necessary cooling functions within the respective compartment or compartments of the appliance 10.

It is contemplated that a multi-directional outlet valve 28 can be continually operated to adjust which evaporator the charged media 22 is delivered to, according to the cooling load necessary to have an actual temperature 124 of a particular compartment that matches the desired temperature 120 of that same compartment. Accordingly, as the multi-evaporator refrigeration system 12 can run continuously for a period of time, the multi-directional outlet valve 28 can operate to change the cooling mode as needed to create actual temperatures 124 within the various compartments that substantially matches the corresponding desired temperature 120 for the various compartments.

Referring again to FIGS. 1-7, as discussed previously, each of the freezer, pantry and refrigerator evaporators 24, 56, 52 of the plurality of evaporators for the multi-evaporator refrigeration system 12 can include a dedicated fan 98. In this manner, the pantry evaporator 56 can include a pantry fan 130 that is positioned proximate the pantry evaporator 56 for selectively moving pantry process air 132 across the pantry evaporator 56. Accordingly, the pantry fan 130 operates when the charged media 22 is delivered from the multi-directional outlet valve 28 to the pantry evaporator 56. Similarly, the refrigerator evaporator 52 can include a refrigerator fan 134 that is positioned proximate the refrigerator evaporator 52 for selectively moving refrigerator process air 136 across the refrigerator evaporator 52. Accordingly, the refrigerator fan 134 is adapted to operate to move the refrigerator process air 136 when the charged media 22 is delivered from the multi-directional outlet valve 28 to the refrigerator evaporator 52. In this manner, operation of the multi-directional outlet valve 28 is typically linked to the operation of the pantry fan 130, the refrigerator fan 134 and the freezer fan 138.

Referring again to FIGS. 2-7, because all of the thermal exchange media 18 moving through the refrigerant line 20 ultimately passes through the freezer evaporator 24 to be returned to the compressor 14, operation of the freezer fan 138 may not always be necessary or desired during operation of the multi-evaporator refrigeration system 12. The freezer fan 138 is typically positioned proximate the freezer evaporator 24 for selectively moving freezer process air 150 across the freezer evaporator 24. The freezer fan 138 operates when the thermal exchange media 18 is delivered from the multi-directional outlet valve 28 and directly to the freezer evaporator 24 as the charged media 22.

Referring again to FIGS. 4-7, when the thermal exchange media 18 is moved through one or both of the refrigerator evaporator 52 and pantry evaporator 56, the freezer fan 138 may be selectively operable between active and idle states 152, 154. When the partially-spent media 32 is delivered from one or both of the pantry or refrigerator evaporators 56, 52, it may be desirable to allow the partially-spent media 32 to move directly through the freezer evaporator 24 without operating the freezer fan 138 in the active state 152 for moving freezer process air 150 into the freezer compartment 44. Such a condition may be used where the actual temperature 124 of the freezer compartment 44 is substantially similar to the desired temperature 120 of the freezer compartment 44 such that additional cooling is not needed at that particular time. Accordingly, the freezer fan 138 may define the idle state 154 such that additional cooling or significant amounts of additional cooling are not provided to the freezer compartment 44.

Alternatively, additional cooling may be necessary within the freezer compartment 44 as the partially-spent media 32 moves through the freezer evaporator 24. In this condition, the freezer fan 138 may define the active state 152. In the active state 152 of the freezer fan 138, as the partially-spent media 32 is delivered from one of the other secondary evaporators 30 and through the freezer evaporator 24, the freezer fan 138 can operate to provide additional cooling to the freezer compartment 44 when necessary.

According to various aspects of the device, as the partially-spent media 32 is moved through the freezer evaporator 24, additional phase change of the partially-spent media 32 may occur as the thermal exchange media 18 moves through the freezer evaporator 24. Accordingly, the use of the freezer evaporator 24 in receiving all of the thermal exchange media 18 that moves through the refrigerant line 20 allows for a completion or substantial completion of the phase change of the thermal exchange media 18 to the low-pressure low-temperature vapor 110. By allowing for a complete or substantially complete phase change, the compressor 14 acting on the thermal exchange media 18 may become more efficient and may also provide greater capacity for the thermal exchange media 18 to reject heat 100 as it moves through the condenser 16 and absorb heat 100 as the thermal exchange media 18 moves through one or more of the refrigerator, pantry and freezer evaporators 52, 56, 24.

Referring again to FIGS. 2-7, as discussed previously, the multi-directional outlet valve 28 is operable to define various cooling modes of the appliance 10. At least one of these modes can include a multi-evaporator position 160, such as the refrigerator/pantry-cooling mode 50. In this multi-evaporator position 160, the thermal exchange media 18, in the form of the charged media 22, can be delivered substantially simultaneously to the pantry evaporator 56 and the refrigerator evaporator 52. As discussed above, after the thermal exchange media 18 leaves the pantry and refrigerator evaporators 56, 52 in the form of the partially-spent media 32, the thermal exchange media 18 is then moved through the multi-directional inlet valve 40 and onto the freezer evaporator 24. After the thermal exchange media 18 is moved through the freezer evaporator 24, it is then returned to the compressor 14 to continue the refrigerant cycle for the appliance 10.

Referring again to FIGS. 2-7, the multi-directional inlet valve 40 is positioned downstream of the multi-directional outlet valve 28 and also downstream of the pantry and refrigerator evaporators 56, 52. The multi-directional inlet valve 40 is positioned upstream of the freezer evaporator 24. In this manner, all of the thermal exchange media 18 leaving the multi-directional outlet valve 28, the pantry evaporator 56 and the refrigerator evaporator 52 can then be directed into and through the multi-directional inlet valve 40. The plurality of inlets 170 receives the thermal exchange media 18 from various positions within the refrigerant line 20 and allows for combinations of these various paths of the thermal exchange media 18 to be directed to a single freezer line 172 that delivers the thermal exchange media 18 from the multi-directional inlet valve 40 to the freezer evaporator 24. Through this configuration, all of the thermal exchange media 18 is directed through the single freezer line 172 to be delivered to the freezer evaporator 24 and then back to the compressor 14. In this manner, the appliance 10 can be adapted to be free of a separate pump-out operation. Because all of the thermal exchange media 18 is moved through the freezer evaporator 24, such a pump-out operation may not be necessary.

Additionally, this configuration of the freezer evaporator 24 connected downstream of the multi-directional inlet valve 40 via the freezer line 172 directs all of the thermal exchange media 18 through the freezer evaporator 24 such that a separate check valve is not necessary within the multi-evaporator refrigeration system 12. Accordingly, as the compressor 14 operates, the high-pressure high-temperature vapor 70 leaving the compressor 14 is adapted to move through the refrigerant line 20. This movement through the refrigerant line 20 ultimately results in all of the thermal exchange media 18 being moved through the multi-directional inlet valve 40 and then to the freezer evaporator 24 via the freezer line 172 and then back to the compressor 14. The risk of backflow of the thermal exchange media 18 within the refrigerant line 20 is largely eliminated or completely eliminated such that check valve is not necessary. Additionally, the absence of a separate pump-out operation of the multi-evaporator refrigeration system 12 also mitigates or fully eliminates the need for check valves within the refrigerant line 20.

Referring again to FIGS. 2-7, the refrigerating appliance 10 can include the refrigerant line 20 having the compressor 14 and the thermal exchange media 18 included within the refrigerant line 20. The plurality of heat exchangers are adapted to selectively receive the thermal exchange media 18. As discussed previously, the plurality of heat exchangers includes the freezer evaporator 24, the pantry evaporator 56 and the refrigerator evaporator 52. The multi-directional inlet valve 40 is adapted to receive the thermal exchange media 18 from at least one of the compressor 14, the pantry evaporator 56 and the refrigerator evaporator 52. Accordingly, the multi-directional inlet valve 40 delivers the thermal exchange media 18 to the freezer evaporator 24. As discussed previously, the multi-directional outlet valve 28 is positioned downstream of the compressor 14 and upstream of the pantry evaporator 56, a refrigerator evaporator 52 and the multi-directional inlet valve 40. In this manner, as the thermal exchange media 18 is moved through and is apportioned by the multi-directional outlet valve 28, the thermal exchange media 18 passes through various branches of the refrigerant line 20 and is returned to the freezer evaporator 24 by the multi-directional inlet valve 40. Accordingly, the multi-directional outlet valve 28 receives the thermal exchange media 18 from the compressor 14 and delivers the thermal exchange media 18 to the multi-directional inlet valve 40. The multi-directional outlet valve 28 is selectively operable to also deliver the thermal exchange media 18 to at least one of the pantry evaporator 56 and a refrigerator evaporator 52 before being delivered to the multi-directional inlet valve 40.

Referring again to FIGS. 2-7, the refrigerant line 20 can include a first portion 180 that extends from the multi-directional outlet valve 28 and defines a plurality of refrigerant paths that each flow along separate routes to the multi-directional inlet valve 40. These plurality of refrigerant paths can include a pantry path 182 that extends through the pantry evaporator 56 and a refrigerator path 184 that extends through the refrigerator evaporator 52. The plurality of refrigerant paths also defines a freezer path 186 that extends directly from the multi-directional outlet valve 28 and to the multi-directional inlet valve 40. The refrigerant line 20 also includes a second portion 188 that extends from the multi-directional inlet valve 40 and defines a single return path in the form of the freezer line 172 that extends through the freezer evaporator 24 and then returns to the compressor 14. Because of the single return path, the pump-out operation and check valves are typically not needed in the refrigerant line 20.

Referring now to FIGS. 4-7, the various cooling modes of the appliance 10 are illustrated for exemplifying at least a portion of the cooling modes of the multi-evaporator refrigerant system. As exemplified in FIG. 4, the thermal exchange media 18 is moved through the multi-directional outlet valve 28 and is directly moved to the multi-directional inlet valve 40. The thermal exchange media 18 is then moved directly into the freezer evaporator 24 for cooling a freezer compartment 44. In this freezer-cooling mode 42, little, if any, of the thermal exchange media 18 is delivered to the pantry or the refrigerator evaporators 56, 52.

Figure 5:
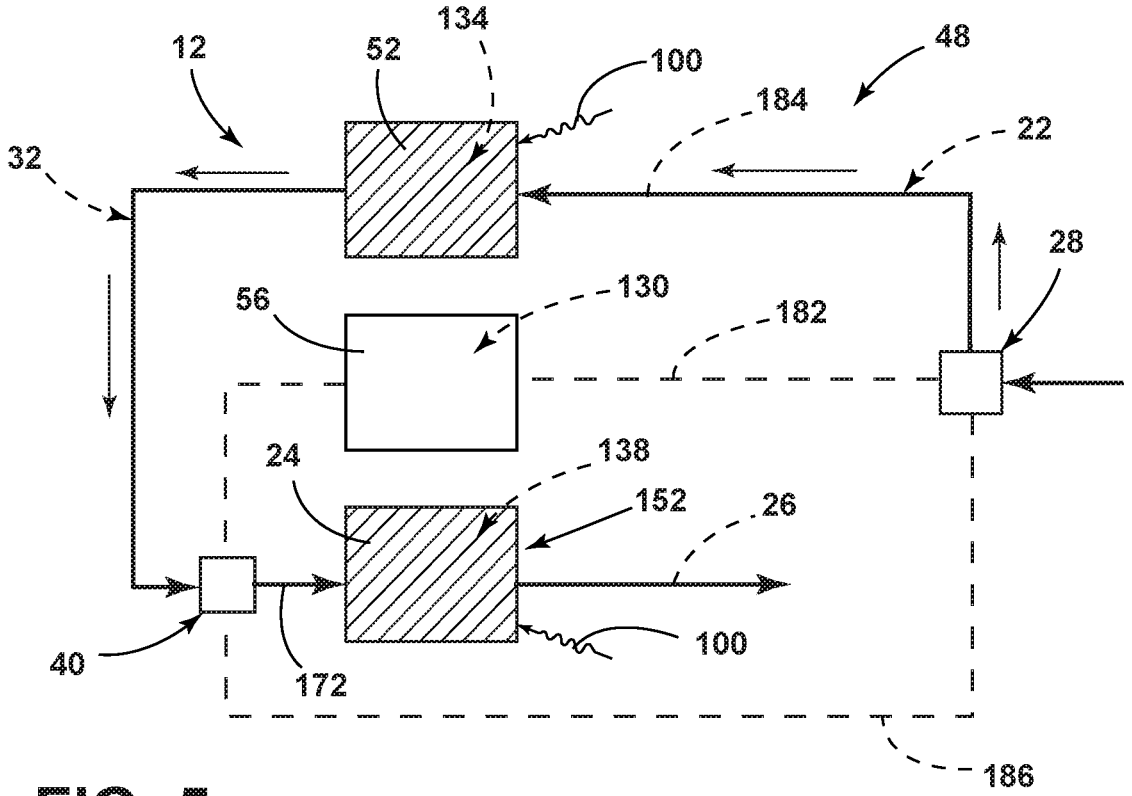
FIG. 5 is a schematic flow diagram illustrating a refrigerator-cooling mode of the multi-evaporator refrigeration system.

As exemplified in FIG. 5, a refrigerator-cooling mode 48 is shown where the thermal exchange media 18 is moved from the multi-directional outlet valve 28 and through the refrigerator evaporator 52. In this refrigerator-cooling mode 48, the refrigerator fan 134 is activated in conjunction with the operation of the multi-directional outlet valve 28 so that as heat 100 is absorbed within the refrigerator evaporator 52, cooled refrigerator process air 136 is formed around the refrigerator evaporator 52 and the refrigerator fan 134 can move this refrigerator process air 136 into the refrigerator compartment 54 for cooling the refrigerator compartment 54. After leaving the refrigerator evaporator 52, the thermal exchange media 18 defines the partially-spent media 32 that is then returned to the multi-directional inlet valve 40. This partially-spent media 32 is then directed to the freezer evaporator 24. In the refrigerator-cooling mode 48, the freezer fan 138 can selectively define the active state 152 or the idle state 154, based upon whether additional cooling is needed within the freezer compartment 44. As the partially-spent media 32 is moved through the freezer evaporator 24, additional phase change occurs to the thermal exchange media 18 as it moves through the freezer evaporator 24. This phase change defines cooled freezer process air 150 that forms around a freezer evaporator 24, the freezer fan 138 can selectively operate to move this freezer process air 150 into the freezer compartment 44. In various aspects of the device, when no cooling is needed in the freezer compartment 44, the freezer fan 138 can also be multi-directional such that the freezer process air 150 can be moved to other portions of the appliance 10 such as to the pantry compartment 58 or the refrigerator compartment 54.

Figure 6:
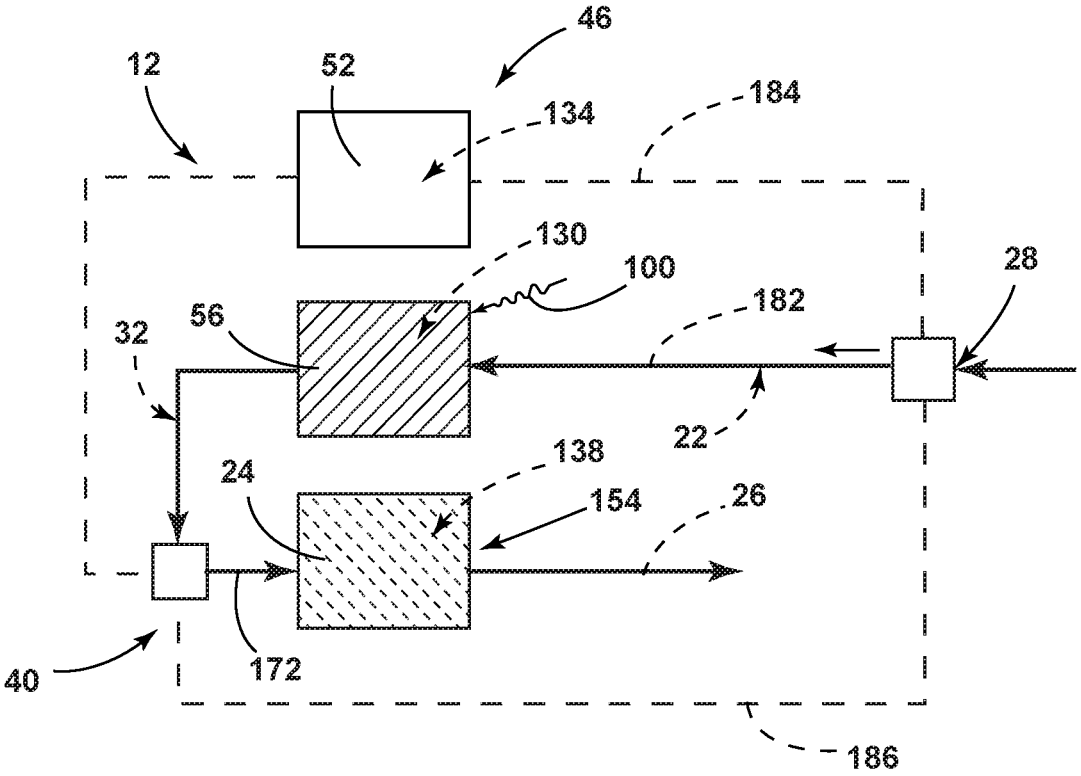
FIG. 6 is a schematic diagram illustrating a pantry-cooling mode of the multi-evaporator refrigeration system.

Referring now to FIG. 6, which exemplifies a pantry-cooling mode 46 of the appliance 10, the thermal exchange media 18 is moved through the multi-directional outlet valve 28 and to the pantry evaporator 56. As the thermal exchange media 18 moves through the pantry evaporator 56, the thermal exchange media 18 undergoes the phase change and absorbs heat 100, thereby forming cooled pantry process air 132 around the pantry evaporator 56. The pantry fan 130 operates in conjunction with the multi-directional outlet valve 28 moved in the pantry-cooling mode 46 and moves the pantry process air 132 into the pantry compartment 58. As with the refrigerator-cooling mode 48, the thermal exchange media 18 leaving the pantry evaporator 56 defines the partially-spent media 32 that is then moved to the multi-directional inlet valve 40 and then to the freezer evaporator 24. Again, the freezer fan 138 may define the active state 152 or the idle state 154 depending upon whether cooling is needed within the freezer compartment 44. Where a multi-directional freezer fan 138 is implemented, the freezer process may also be moved to another portion of the appliance 10 other than, or in addition to, the freezer compartment 44.

Figure 7:
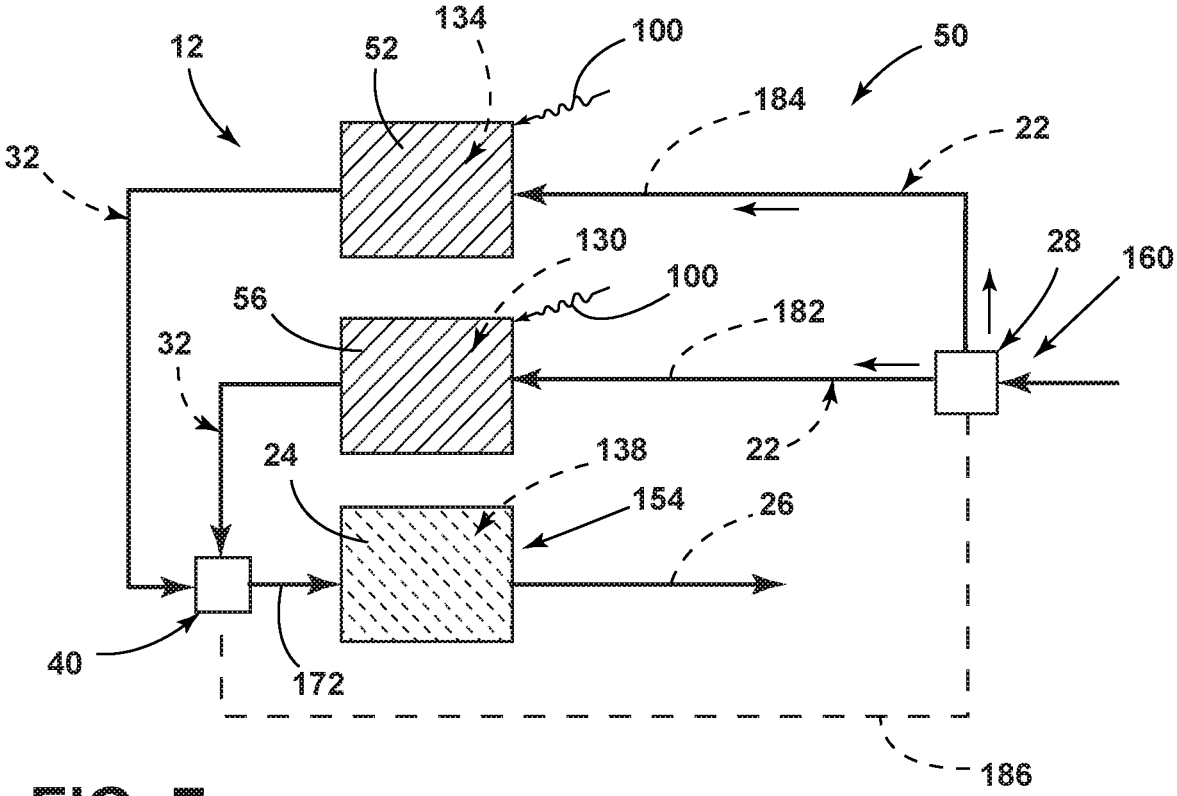
FIG. 7 is a schematic diagram illustrating a refrigerator/pantry-cooling mode of the multi-evaporator refrigeration system.

Referring now to FIG. 7, a combination refrigerator/pantry-cooling mode 50 is defined where thermal exchange media 18 leaving the multi-directional outlet valve 28 is moved to both the refrigerator and pantry evaporators 52, 56. The phase change of the thermal exchange media 18 absorbs heat 100 from around each of the refrigerator and pantry evaporators 52, 56 and defines the refrigerator process air 136 and pantry process air 132, respectively. The refrigerator and pantry fans 134, 130 operate to move the refrigerator process air 136 and pantry process air 132 into the refrigerator and pantry compartments 54, 58 for cooling these compartments as desired. Thermal exchange media 18 leaving the refrigerator and pantry evaporators 52, 56 is in the form of a partially-spent media 32 that is then delivered through the multi-directional inlet valve 40 to the freezer evaporator 24. Again, the freezer fan 138 may define the active state 152 or the idle state 154 depending upon whether additional cooling is needed within the freezer evaporator 24.

According to various aspects of the device, the multi-directional outlet valve 28 can be operated by various valve actuators 196. These valve actuators 196 can include an electric actuator, hydraulic actuators, pneumatic actuators, spring-loaded actuators, and other similar valve actuators 196. Where an electrical actuator is used, the electrical actuator can be in the form of a stepper motor, servo motor, electro valve, or other similar actuators. In various aspects of the device, the multi-directional inlet valve 40 may also include a valve actuator 196 that operates the multi-directional inlet valve 40 cooperatively with the multi-directional outlet valve 28.

Figure 8:
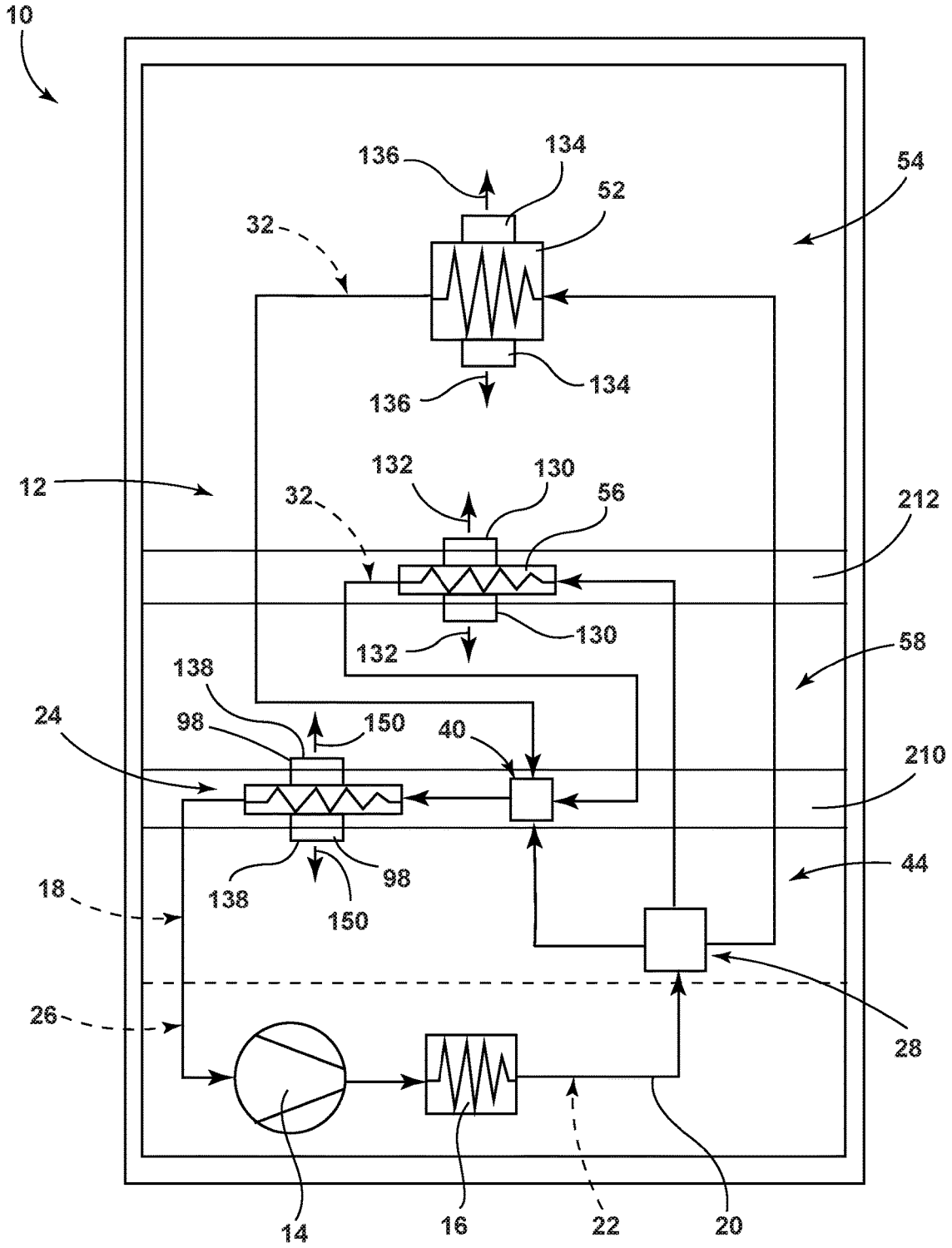
FIG. 8 is a schematic diagram illustrating an aspect of the multi-evaporator refrigeration system having evaporators disposed proximate the interior mullions of the appliance.
Figure 9:
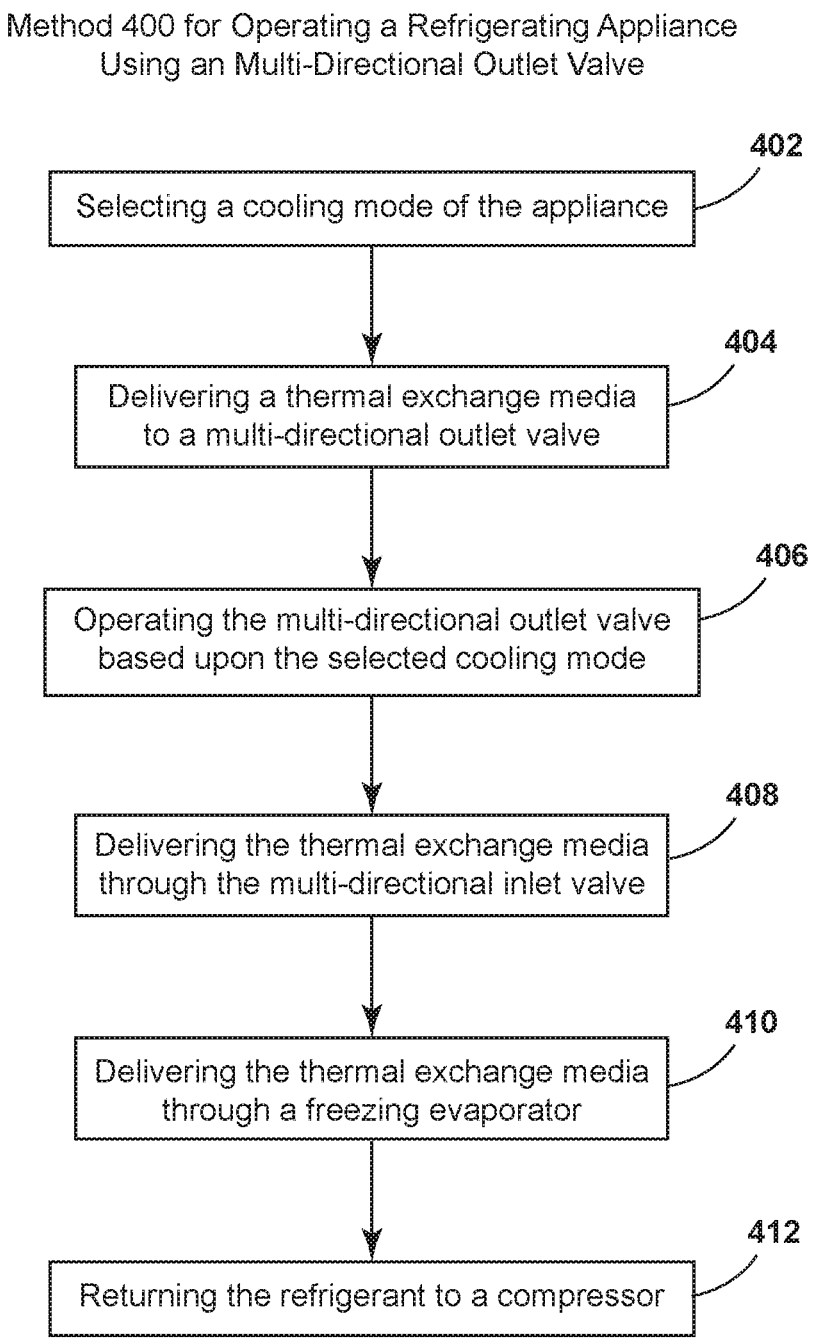
FIG. 9 is a schematic flow diagram illustrating a method for operating the refrigerating appliance utilizing a multi-directional outlet valve.

Referring now to FIG. 8, another aspect of the multi-evaporator refrigeration system 12 is disclosed. In this aspect of the device, one or more of a plurality of evaporators can be disposed within a mullion 210 or false mullion 212 of the appliance 10 and proximate two adjacent compartments within the appliance 10. Accordingly, as exemplified in FIG. 8, the freezer evaporator 24 can be positioned adjacent the freezer compartment 44 and the pantry compartment 58 and the pantry evaporator 56 can be disposed adjacent the pantry compartment 58 and the refrigerator compartment 54. In this manner, the refrigerator fan 134, pantry fan 130, and freezer fan 138 can be operated to provide cooling functionality to multiple compartments. In such an embodiment, additional cooling can be provided to a single compartment and from multiple evaporators, where greater amounts of cooling are needed in a short period of time.

Referring now to FIGS. 1-9, having described various aspects of the device, a method 400 is disclosed for operating a refrigerating appliance 10, using a multi-directional outlet valve 28 for delivering a thermal exchange media 18 to one or more evaporators. According to the method 400, a refrigerating mode of the appliance 10 is selected (step 402). Selecting the appropriate refrigerating mode can be accomplished manually through a user interface 220 or automatically through use of a processor 80 in communication with various temperature sensors 122 disposed within the refrigerator compartment 54, the pantry compartment 58 and the freezer compartment 44. These temperature sensors 122 monitor the actual temperature 124 within each respective compartment and deliver this information to a processor 80. The processor 80 then monitors the current actual temperature 124 within each of the compartments and compares these actual temperatures 124 with a corresponding desired temperature 120 set by the user. Where the actual temperature 124 is above the desired temperature 120, a particular refrigerating mode can be actuated in order to provide cooling to an appropriate compartment. After the refrigerating mode is selected, the thermal exchange media 18, typically in the form of a refrigerant, can be delivered to the multi-directional outlet valve 28 (step 404). As discussed above, the thermal exchange media 18 moves from the compressor 14 through the condenser 16 and then to the multi-directional outlet valve 28. It is contemplated that various dryers and other fixtures typically seen within refrigerating systems can be disposed within the refrigerant line 20 between the condenser 16 and the multi-directional outlet valve 28.

After the refrigerating mode is selected and the thermal exchange media 18 is delivered to the multi-directional outlet valve 28, the multi-directional outlet valve 28 is operated based upon the selected mode of the appliance 10 (step 406). In this manner, the multi-directional outlet valve 28 is operated so that the appropriate evaporator or evaporators are placed in communication with the compressor 14 and condenser 16 via the multi-directional outlet valve 28. The thermal exchange media 18 is then delivered through the multi-directional inlet valve 40 (step 408). As discussed previously in all refrigerating modes of the appliance 10, the thermal exchange media 18 is moved from the multi-directional outlet valve 28 and then to the multi-directional inlet valve 40. Depending upon the refrigerating mode, the thermal exchange media 18 may also be delivered through one or both of the pantry evaporator 56 and the refrigerator evaporator 52 and then moved onto the multi-directional inlet valve 40. After moving through the multi-directional inlet valve 40, the thermal exchange media 18 is then moved through the freezer evaporator 24 (step 410). When the freezer-cooling mode 42 is selected, the thermal exchange media 18 moves directly from the multi-directional outlet valve 28 to the multi-directional inlet valve 40 and then to the freezer evaporator 24. Where the selected cooling mode is one of the pantry-cooling mode 46, refrigerator-cooling mode 48 or a combination refrigerator/pantry-cooling mode 50, the thermal exchange media 18 is in the form of a partially-spent media 32 that is then delivered to the multi-directional inlet valve 40. This partially-spent media 32 is then moved to the freezer evaporator 24. As the partially-spent media 32 moves through the freezer evaporator 24, additional phase change of the thermal exchange media 18 may occur where additional heat 100 is absorbed by the thermal exchange media 18 moving through the freezer evaporator 24. After moving through the freezer evaporator 24, the thermal exchange media 18 is then returned to the compressor 14 (step 412).

According to various aspects of the device, the multi-evaporator refrigeration system 12 can be used within various appliances 10 that have separate areas that are to be cooled by a single refrigerating system. Such appliances 10 can include, but are not limited to, freezers, refrigerators, coolers, combinations thereof and other similar appliances 10.

According to various aspects of the device, the thermal exchange media 18 can be in the form of a refrigerant, water, air, and other similar media that can be used to absorb and reject heat 100 for cooling various portions of a refrigerating appliance 10.

According to various aspects of the device, the multi-directional outlet valve 28 can include a single input port and multiple output ports. As exemplified in FIGS. 2-8, the multi-directional outlet valve 28 includes three output ports. It is contemplated that the multi-directional outlet valve 28 can include more output ports for serving various portions of an appliance 10. These portions can include, but are not limited to, ice makers, chillers, additional pantry spaces within a pantry compartment 58, crispers and other similar compartments within the appliance 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerating appliance comprising:

a refrigerant line having a compressor and a condenser;

a thermal exchange media that is delivered from the condenser and through the refrigerant line to at least a freezer evaporator of a plurality of evaporators, wherein the thermal exchange media leaving the freezer evaporator defines spent media that is returned to the compressor; and a multi-directional outlet valve that selectively delivers the thermal exchange media to the freezer evaporator, wherein the multi-directional outlet valve also selectively delivers the thermal exchange media to at least one secondary evaporator of the plurality of evaporators to define a partially-spent media that is delivered to the freezer evaporator, wherein the refrigerant line includes a multi-directional inlet valve that selectively receives at least one of the thermal exchange media from the multi-directional outlet valve and the partially-spent media from the at least one secondary evaporator for delivery to the freezer evaporator.

2. The refrigerating appliance of claim 1, wherein the freezer evaporator and each of the secondary evaporators includes a dedicated media expansion device that is positioned within the refrigerant line and downstream of the multi-directional outlet valve.

3. The refrigerating appliance of claim 1, wherein the secondary evaporators include a pantry evaporator and a refrigerator evaporator.

4. The refrigerating appliance of claim 3, wherein a pantry fan is positioned proximate the pantry evaporator for selectively moving pantry process air across the pantry evaporator, wherein the pantry fan operates when the thermal exchange media is delivered from the multi-directional outlet valve to the pantry evaporator.

5. The refrigerating appliance of claim 3, wherein a refrigerator fan is positioned proximate the refrigerator evaporator for selectively moving refrigerator process air across the refrigerator evaporator, wherein the refrigerator fan operates when the thermal exchange media is delivered from the multi-directional outlet valve to the refrigerator evaporator.

6. The refrigerating appliance of claim 3, wherein a freezer fan is positioned proximate the freezer evaporator for selectively moving freezer process air across the freezer evaporator, wherein the freezer fan operates when the thermal exchange media is delivered from the multi-directional outlet valve to the freezer evaporator, and wherein the freezer fan is selectively operable between active and idle states when the partially-spent media is delivered from at least one of the pantry and refrigerator evaporators to the freezer evaporator.

7. The refrigerating appliance of claim 6, wherein the idle state of the freezer fan defines passage of the partially-spent media through the freezer evaporator when a freezer compartment served by the freezer evaporator defines a desired freezer temperature.

8. The refrigerating appliance of claim 6, wherein the multi-directional outlet valve is operable to define a multi-evaporator position, wherein the thermal exchange media is delivered substantially simultaneously to the pantry evaporator and the refrigerator evaporator.

9. The refrigerating appliance of claim 1, wherein the refrigerant line is free of check valves.

10. The refrigerating appliance of claim 1, wherein the refrigerant line is free of a separate pump-out operation.

* * * * *